US010167181B2

(12) United States Patent
Xu

(10) Patent No.: US 10,167,181 B2
(45) Date of Patent: Jan. 1, 2019

(54) HYDRAULIC STEERING SHEAR-FORK TYPE AERIAL WORK PLATFORM

(71) Applicant: ZHEJIANG DINGLI MACHINERY CO., LTD., Huzhou, Zhejiang Province (CN)

(72) Inventor: Shugen Xu, Huzhou (CN)

(73) Assignee: CHEJIANG DINGLI MACHINERY CO., LTD., Huzhou, Zhejiang (CN)

( * ) Notice: Subject to any disclaimer, the term of this patent is extended or adjusted under 35 U.S.C. 154(b) by 110 days.

(21) Appl. No.: 15/217,227

(22) Filed: Jul. 22, 2016

(65) Prior Publication Data

US 2018/0022591 A1 Jan. 25, 2018

(51) Int. Cl.
*B66F 11/04* (2006.01)

(52) U.S. Cl.
CPC ..... *B66F 11/042* (2013.01)

(58) Field of Classification Search
CPC ..... B66F 9/07513; B66F 9/07522; B66F 9/07586; B66F 9/105; B66F 11/04; B66F 11/042; B66F 11/046; B66F 11/048; B66F 11/00; B66F 17/006
See application file for complete search history.

(56) References Cited

U.S. PATENT DOCUMENTS 6,050,365 A * 4/2000 Newlin ..... B66F 11/042 182/14
6,264,221 B1 * 7/2001 Bowden ..... B60G 17/005 267/255
7,194,358 B2 * 3/2007 Callaghan ..... B66B 5/0031 182/112
9,050,985 B1 * 6/2015 Chapman ..... B62B 3/001
9,057,481 B1 * 6/2015 Chapman ..... F16M 11/42
9,108,831 B2 * 8/2015 Beji ..... B66F 11/04
9,327,953 B2 * 5/2016 Sayles ..... B66F 11/04
9,638,986 B1 * 5/2017 Chapman ..... G03B 17/561
9,914,626 B2 3/2018 Shugen
2003/0029673 A1 * 2/2003 Puszkiewicz ..... B66F 9/06 182/69.1
2004/0035636 A1 * 2/2004 Julien ..... B66F 11/042 182/69.6

(Continued)

FOREIGN PATENT DOCUMENTS

CN 102219165 B 1/2013
CN 204588642 U 8/2015

(Continued)

*Primary Examiner* — Daniel P Cahn
(74) *Attorney, Agent, or Firm* — NK Patent Law

(57) ABSTRACT

The disclosed subject matter is directed to a hydraulic steering shear-fork aerial work platform that comprises a running chassis and a lifting device. The running chassis includes a chassis body and a running device that comprises a left wheel carrier, a right wheel carrier, a linkage frame, and a steering oil cylinder. The left wheel carrier and the right wheel carrier are rotatably installed on the chassis body through wheel carrier shafts. The two ends of the linkage frame are respectively hinged to the left wheel carrier and the right wheel carrier. One end of the steering oil cylinder is installed at one end of the linkage frame, and the other end of the steering oil cylinder is fixedly connected with the wheel carrier shaft through an installing plate.

4 Claims, 5 Drawing Sheets

(56) References Cited

U.S. PATENT DOCUMENTS

2004/0045768 A1* 3/2004 Puszkiewicz ..... B66F 17/006 182/69.5
2005/0224290 A1* 10/2005 Sannah ..... B66F 11/042 182/141
2006/0225955 A1* 10/2006 Murphy ..... B66F 11/042 182/69.5
2010/0193290 A1* 8/2010 Cui ..... B66F 11/042 182/69.5
2011/0042164 A1* 2/2011 Clark ..... B66F 17/006 182/2.2
2011/0198141 A1* 8/2011 Clark ..... B60K 6/48 180/65.265
2012/0186908 A1* 7/2012 Crook ..... B66F 11/042 182/69.5
2014/0265254 A1* 9/2014 Sekine ..... B66F 9/07586 280/638
2015/0259185 A1* 9/2015 Ditty ..... B66F 17/006 182/19
2016/0130124 A1* 5/2016 McVicar ..... B62D 12/00 280/442
2016/0340162 A1* 11/2016 Standard ..... B62B 5/00
2016/0362284 A1* 12/2016 Haessler ..... B66F 11/04
2017/0001846 A1* 1/2017 Paavolainen ..... B66C 13/40
2017/0137269 A1* 5/2017 Shugen ..... B66F 9/205
2017/0137270 A1* 5/2017 Shugen ..... B66F 11/04
2017/0137271 A1* 5/2017 Shugen ..... B66F 11/04
2017/0217745 A1* 8/2017 Artoni ..... B62D 21/00
2017/0267507 A1* 9/2017 Frame ..... B66F 17/006
2017/0283229 A1* 10/2017 Shi ..... B66F 17/006
2017/0341918 A1* 11/2017 Richardson ..... B66F 17/006

FOREIGN PATENT DOCUMENTS

CN 105060197 A 11/2015
CN 205222622 U 5/2016

* cited by examiner

HYDRAULIC STEERING SHEAR-FORK TYPE AERIAL WORK PLATFORM

BACKGROUND OF THE INVENTION

Technical Field

This invention relates to the technical field of lifting platforms, in particular to a hydraulic steering shear-fork type aerial work platform.

Description of Related Art

An aerial work platform is a movable aerial work product for aerial work, equipment installation, maintenance and the like for all industries. Related products of the aerial work platform mainly include shear-fork type, gantry type, straight arm type, crank arm type, sleeve type, mast column type, guide frame climbing type products and so on.

The hydraulic steering shear-fork type aerial work platform has higher stability, a wide work platform body and higher bearing capability, enables an aerial work range to be wider and is suitable for simultaneous operation of multiple persons. The platform enables the aerial work efficiency to be higher and further guarantees safety. The product integrates four-wheel movement and two-wheel traction, adopts the chassis of an automobile, a tricycle or an accumulator car as a platform chassis, is powered on by an engine itself or direct current, can run and also drive the platform body to ascend or descend and is widely applied to aerial work in the industries of urban construction, oil fields, traffic, municipal administration, plant areas and the like. For example, an application for a Chinese invention patent, with the application number 201510438415.1, discloses an aerial work platform having high stability and capable of steering during running. The aerial work platform comprises a running chassis and a lifting device, wherein a running device comprises a left steering wheel, a right steering wheel and a supporting leg structure, the running chassis comprises a frame plate, supporting leg seat plates, supporting leg installing plates, outer supporting pipes, inner supporting pipes and supporting legs, the lifting device comprises a shear type lifting structure and a work platform body, the work platform body comprises a platform fixing base plate, a handrail frame and a handrail gate.

Existing shear-fork type aerial work platforms are larger in size and cannot adapt to multiple occasions well. If the sizes of the existing shear-fork type aerial work platforms are decreased, many problems will appear, such as steering arrangement, and existing steering mechanisms cannot to adapt to the size-decreased shear-fork type aerial work platforms due to larger size and complicated structure.

BRIEF SUMMARY OF THE INVENTION

For solving the technical problems, the invention provides a hydraulic steering shear-fork type aerial work platform.

The technical scheme for solving the problems of the invention is as follows:

The hydraulic steering shear-fork type aerial work platform comprises a running chassis and a lifting device, the running chassis comprises a chassis body and a running device, the running device comprises a left steering wheel, a right steering wheel, a left wheel carrier, a right wheel carrier, a linkage frame and a steering oil cylinder, the left steering wheel and the right steering wheel are respectively installed on the left wheel carrier and the right wheel carrier, and the left wheel carrier and the right wheel carrier are rotatably installed on the chassis body through wheel carrier shafts. The two ends of the linkage frame are respectively hinged to the left wheel carrier and the right wheel carrier. The linkage frame further comprises a steering oil cylinder installing portion for one end of the steering oil cylinder to be installed. The other end of the steering oil cylinder is fixedly connected with the wheel carrier shaft through an installing plate, so that the left steering wheel and the right steering wheel turn towards one side when the steering oil cylinder is controlled to extend, and the left steering wheel and the right steering wheel turn towards the other side when the steering oil cylinder is controlled to withdraw.

In one preferred implementation of the technical scheme, the left steering wheel and the right steering wheel are respectively driven by a left driving motor fixed to the left wheel carrier and a right driving motor fixed to the right wheel carrier.

In another preferred implementation of the technical scheme, the running device further comprises a left rear wheel and a right rear wheel, the left rear wheel and the right rear wheel are respectively driven by the left driving motor and the right driving motor fixed to the chassis body; the left steering wheel and the right steering wheel are installed respectively through a left wheel connecting disc fixed to the left wheel carrier and a right wheel connecting disc fixed to the right wheel carrier.

In the preferred implementation of the technical scheme, the lifting device comprises a shear-fork type lifting structure and a lifting platform, the shear-fork type lifting structure is formed by connecting a plurality of shear-fork units, one end of the shear-fork unit at the bottom is hinged to the running chassis, the other end of the shear-fork unit is hinged to a sliding block, and the sliding block is in a sliding fit with the running chassis; the lifting device further comprises a lifting detection and control system, the lifting detection and control system comprises a potentiometer installed on a rotation shaft of the shear-fork type lifting structure and a controller, any lifting height corresponds to the unique rotating angle of the rotation shaft, the potentiometer can show a unique resistance value, the unique resistance value corresponding to all heights is recorded in the controller, and the limit on the lifting height of the lifting device is achieved by setting the resistance value.

In the preferred implementation of the technical scheme, the chassis body further comprises a pit hole assembly, the pit hole assembly comprises a flip plate, a clamping claw, a lower connecting rod, a middle connecting rod and a press rod, the press rod is movably installed inside a sleeve, the upper end of the press rod is pressed by the lifting device, the lower end of the press rod abuts against a press wheel rotatably connected to one end of the middle connecting rod, the other end of the middle connecting rod is rotatably connected with one end of the lower connecting rod, the other end of the lower connecting rod is movably connected with one end of the clamping claw, and the clamping claw is used for fixing the flip plate. The middle of the middle connecting rod is rotatably connected to a base plate through a first shaft, and the other end of the clamping claw is rotatably connected to the base plate through a second shaft. When the lifting device descends, the lifting device presses the upper end of the press rod, a force is transferred to one end of the middle connecting rod through the press wheel and then is transferred to the other end of the middle connecting rod through rotation of the middle connecting rod, the force is transferred to the lower connecting rod, the lower connecting rod transfers a part of the force to the clamping claw, and the other part of the force acts on an air rod to make the air rod withdraw and accumulate potential energy in the air rod. In addition, due to the fact that the clamping claw and the flip plate are fixed, the flip plate can be put away. When the lifting device ascends, the stress exerted on the upper end of the press rod is released, the potential energy stored in the air rod is converted, the air rod is opened and acts on the lower connecting rod in a force mode, on the one hand, the flip plate is driven to be erected, and on the other hand, the press rod is reset through force transfer to adapt to pressing again from the lifting device. When the flip plate is erected, a complete machine can be prevented from being caught in a pit hole.

In the preferred implementation of the technical scheme, the chassis body is provided with a drawer, and a hydraulic oil pump, a controller and an accumulator of the steering oil cylinder are arranged in the drawer.

In the preferred implementation of the technical scheme, the power lines and signal lines of the hydraulic oil pump, the controller and the accumulator are led out of the drawer and then are movably installed at fixed positions through drag chains arranged on the chassis body.

The hydraulic steering shear-fork type aerial work platform has the advantages that:

1. By the adoption of the ingenious configuration of the steering oil cylinder, a steering system is simplified and can adapt to a chassis of a size-decreased shear-fork type lifting machine;

2. By the adoption of the configuration scheme where a front drive is used for forward steering or a rear drive is used for backward steering, the steering flexibility is also improved while the chassis is simplified;

3. The pit hole assembly is further arranged on the chassis of the hydraulic steering shear-fork type aerial work platform, so that the complete machine is prevented from being caught in the pit hole, meanwhile the running speed of the machine is improved, and the machine can also quickly run even if a lifting assembly ascends.

4. The drawer is further arranged on the chassis of the hydraulic steering shear-fork type aerial work platform, so that the hydraulic oil pump, the controller and the accumulator are arranged in the drawer, and the drawer can be pulled out to facilitate maintenance when a fault occurs.

5. Due to size decrease and structure simplification, the limit on the lifting height of the lifting device by arranging a travel switch is inconvenient; therefore, the platform adopts the potentiometer, the potentiometer is arranged on the shaft of the lifting device, any lifting height corresponds to the unique rotating angle of the rotation shaft, the potentiometer can show the unique resistance value, the unique resistance value corresponding to all heights is recorded in the controller, and the limit on the lifting height of the lifting device is achieved by setting the resistance value.

As shown in the figures, 1—running chassis; 2—lifting device;

11—chassis body; 12—running device;

21—shear-fork type lifting structure; 22—lifting platform;

11-1—flip plate, 11-2—clamping claw, 11-3—lower connecting rod, 11-4—middle connecting rod, 11-5—press rod, 11-6—base plate, 11-7—first shaft, 11-8—second shaft, 11-9—air rod;

121—left steering wheel, 122—right steering wheel, 123—left wheel carrier, 124—right wheel carrier, 125—linkage frame, 126—steering oil cylinder, 127—installing plate, 128—left driving motor, 129—right driving motor, 130—wheel carrier shaft; 1251—steering oil cylinder installing portion; 131—left wheel connecting disc, 132—right wheel connecting disc; 128'—left driving motor, 129'—right driving motor.

DETAILED DESCRIPTION OF THE INVENTION

Embodiment 1

Figure 1:
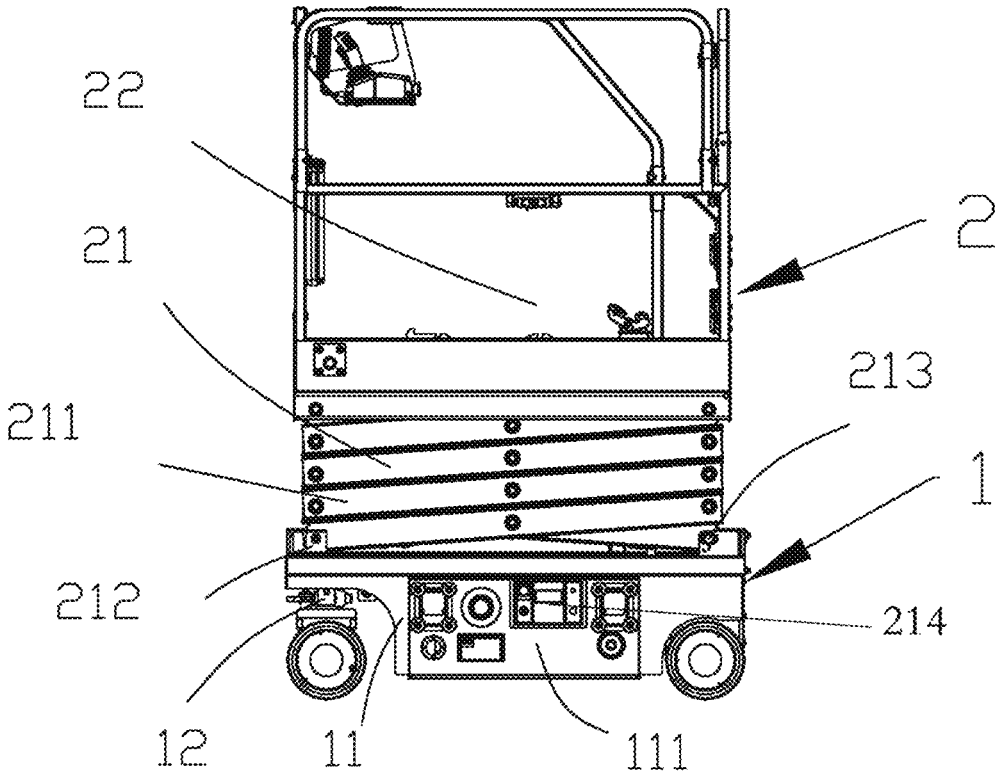
FIG. 1 is a side view of the invention.

As shown in FIG. 1, a front-drive front-steering shear-fork type aerial work platform comprises a running chassis 1 and a lifting device 2. The running chassis comprises a chassis body 11 and a running device 12. The lifting device 2 comprises a shear-fork type lifting structure 21 and a lifting platform 22.

Figure 2:
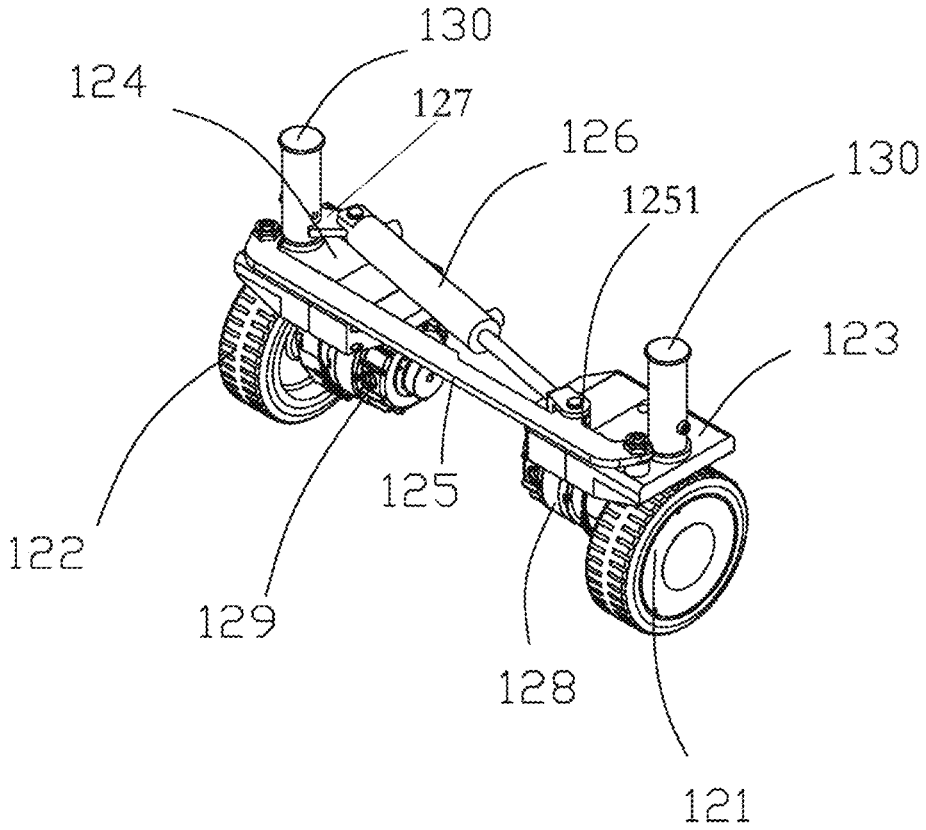
FIG. 2 is a structural view of a running device of the embodiment 1 of the invention.

As shown in FIG. 2, the running device 12 comprises a left steering wheel 121, a right steering wheel 122, a left wheel carrier 123, a right wheel carrier 124, a linkage frame 125 and a steering oil cylinder 126, and the left steering wheel 121 and the right steering wheel 122 are respectively installed on the left wheel carrier 123 and the right wheel carrier 124 and are respectively driven by a left driving motor 128 fixed to the left wheel carrier 123 and a right driving motor 129 fixed to the right wheel carrier 124. The left wheel carrier 123 and the right wheel carrier 124 are rotatably installed on the chassis body 11 through wheel carrier shafts 130. The two ends of the linkage frame 125 are respectively hinged to the left wheel carrier 123 and the right wheel carrier 124. The linkage frame 125 further comprises a steering oil cylinder installing portion 1251 for one end of the steering oil cylinder 126 to be installed. The other end of the steering oil cylinder 126 is fixedly connected with the wheel carrier shaft 130 through an installing plate 127, so that the left steering wheel 121 and the right steering wheel 122 turn towards one side when the steering oil cylinder 126 is controlled to extend, and the left steering wheel 121 and the right steering wheel 122 turn towards the other side when the steering oil cylinder 126 is controlled to withdraw.

As shown in FIG. 1, the shear-fork type lifting structure 21 is formed by connecting a plurality of shear-fork units 211, one end of the shear-fork unit 211 at the bottom is hinged to the running chassis 1, the other end of the shear-fork unit 211 is hinged to a sliding block 212, and the sliding block 212 is in sliding fit with the running chassis 1. The lifting device further comprises a lifting detection and control system, the lifting detection and control system comprises a potentiometer 213 installed on the rotation shaft of the shear-fork type lifting structure 21 and a controller, any lifting height corresponds to the unique rotating angle of the rotation shaft, the potentiometer 213 can show a unique resistance value, the unique resistance value corresponding to all heights is recorded in the controller, and the limit on the lifting height of the lifting device is achieved by setting the resistance value.

Figure 3:
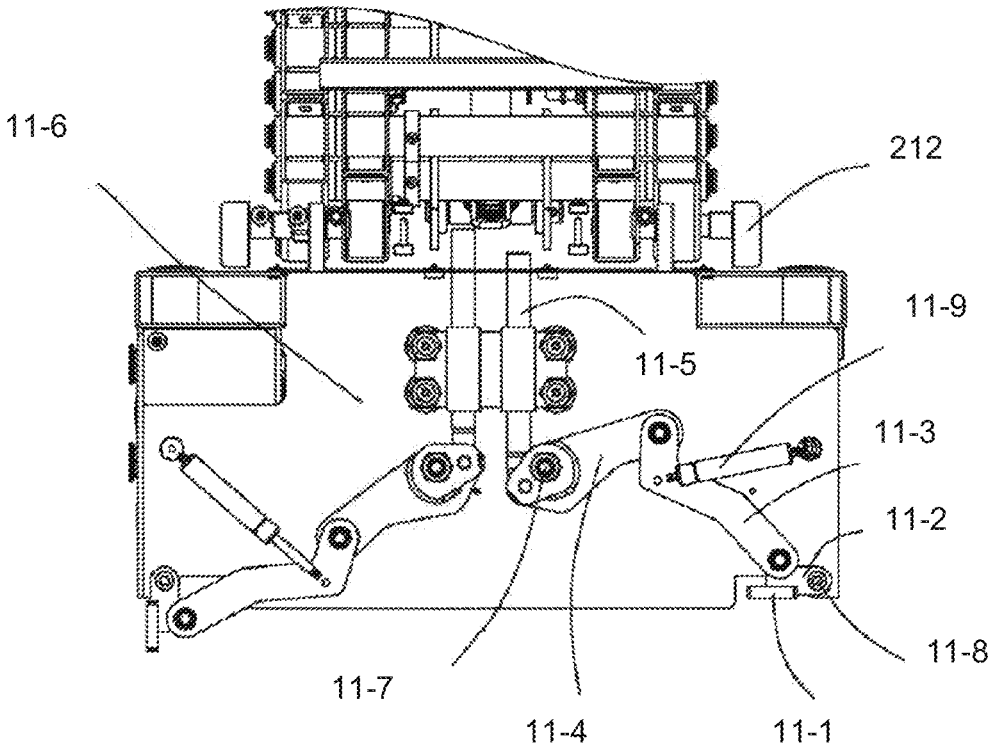
FIG. 3 is a structural view of a pit hole assembly of the invention.

As shown in FIG. 3, the chassis body 11 further comprises a pit hole assembly, the pit hole assembly comprises a flip plate 11-1, a clamping claw 11-2, a lower connecting rod 11-3, a middle connecting rod 11-4 and a press rod 11-5, the press rod 11-5 is movably installed inside a sleeve, the upper end of the press rod is pressed by the lifting device 2, the lower end of the press rod abuts against a press wheel rotatably connected to one end of the middle connecting rod 11-4, the other end of the middle connecting rod 11-4 is rotatably connected with one end of the lower connecting rod 11-3, the other end of the lower connecting rod 11-3 is movably connected with one end of the clamping claw 11-2, and the clamping claw 11-2 is used for fixing the flip plate 11-1. The middle of the middle connecting rod 11-4 is rotatably connected to the base plate 11-6 through a first shaft 11-7, and the other end of the clamping claw 11-2 is rotatably connected to the base plate 11-6 through a second shaft 11-8. When the lifting device 2 descends, the lifting device 2 presses the upper end of the press rod 11-5, a force is transferred to one end of the middle connecting rod 11-4 through the press wheel and then is transferred to the other end of the middle connecting rod 11-4 through rotation of the middle connecting rod 11-4, the force is transferred to the lower connecting rod 11-3, the lower connecting rod 11-3 transfers a part of the force to the clamping claw 11-2, and the other part of the force acts on an air rod 11-9 to make the air rod 11-9 withdraw and accumulate potential energy in the air rod 11-9. In addition, due to the fact that the clamping claw 11-2 and the flip plate 11-1 are fixed, the flip plate 11-1 can be put away. When the lifting device 2 ascends, the stress exerted on the upper end of the press rod 11-5 is released, the potential energy stored in the air rod 11-9 is converted, the air rod 11-9 is opened and acts on the lower connecting rod 11-3 in a force mode, on the one hand, the flip plate 11-1 is driven to be erected, and on the other hand, the press rod 11-5 is reset through force transfer to adapt to pressing again from the lifting device 2. When the flip plate 11-1 is erected, the complete machine can be prevented from being caught in a pit hole.

As shown in FIG. 1, the chassis body 11 is provided with a drawer 111, and a hydraulic oil pump, a controller and an accumulator of the steering oil cylinder 126 are arranged in the drawer 111. The power lines and signal lines of the hydraulic oil pump, the controller and the accumulator are led out of the drawer 111 and then are movably installed at fixed positions through drag chains arranged on the chassis body 11.

Embodiment 2

As shown in FIG. 1, a rear-drive front-steering shear-fork type aerial work platform comprises a running chassis 1 and a lifting device 2. The running chassis comprises a chassis body 11 and a running device 12. The lifting device 2 comprises a shear-fork type lifting structure 21 and a lifting platform 22.

Figure 4:
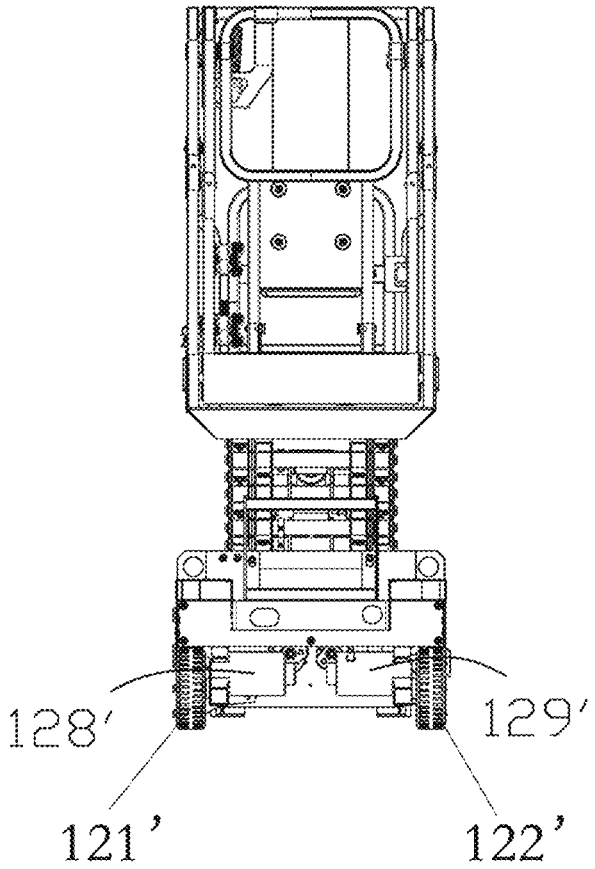
FIG. 4 is a rear view of the embodiment 2 of the invention.
Figure 5:
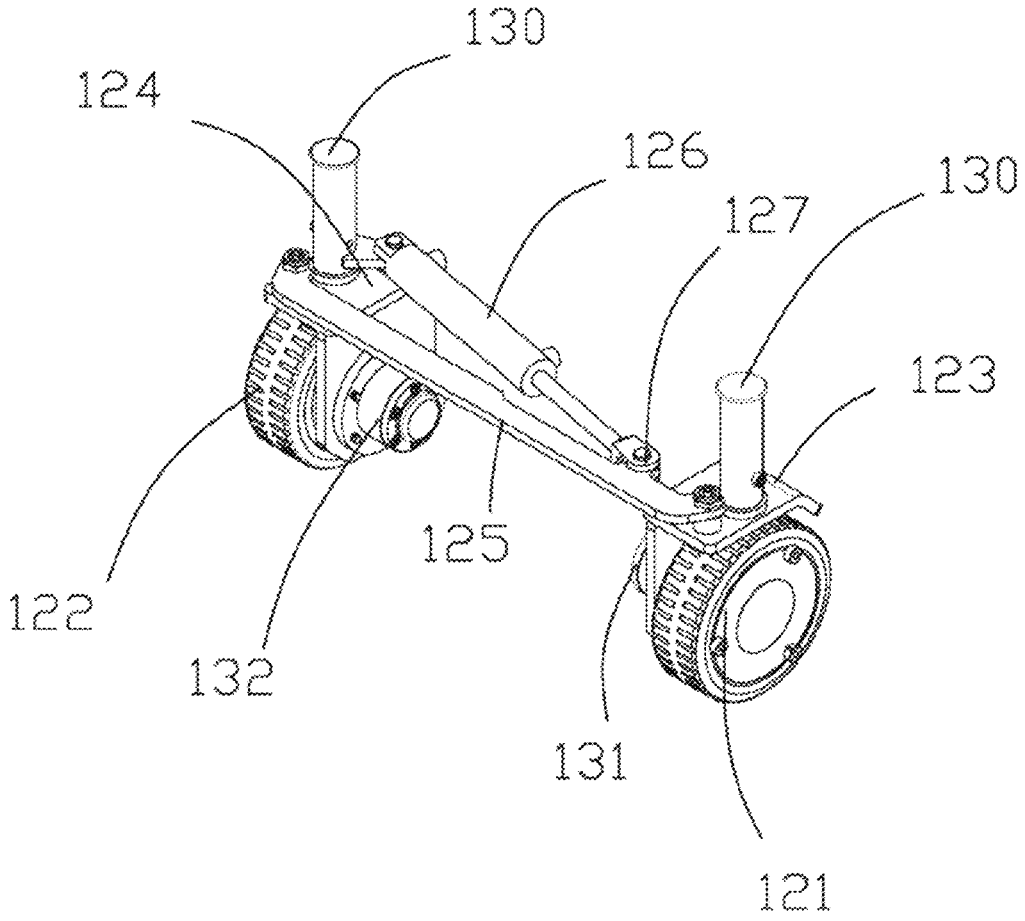
FIG. 5 is a structural view of a running device of the embodiment 2 of the invention.

As shown in FIGS. 4 and 5, the running device 12 comprises a left steering wheel 121, a right steering wheel 122, a left wheel carrier 123, a right wheel carrier 124, a left wheel connecting disc 131, a right wheel connecting disc 132, a linkage frame 125, a steering oil cylinder 126, a left rear wheel, a right rear wheel, a left driving motor 128' and a right driving motor 129'. The left rear wheel and the right rear wheel are driven respectively by the left driving motor 128' and the right driving motor 129' fixed to the chassis body 11. The left steering wheel 121 and the right steering wheel 122 are installed respectively through the left wheel connecting disc 131 fixed to the left wheel carrier 123 and the right wheel connecting disc 132 fixed to the right wheel carrier 123.

The left wheel carrier 123 and the right wheel carrier 124 are rotatably installed on the chassis body 11 through the wheel carrier shafts 130.

The two ends of the linkage frame 125 are respectively hinged to the left wheel carrier 123 and the right wheel carrier 124. The linkage frame 125 further comprises a steering oil cylinder installing portion 1251 for one end of the steering oil cylinder 126 to be installed. The other end of the steering oil cylinder 126 is fixedly connected with the wheel carrier shaft 130 through an installing plate 127, so that the left steering wheel 121 and the right steering wheel 122 turn towards one side when the steering oil cylinder 126 is controlled to extend, and the left steering wheel 121 and the right steering wheel 122 turn towards the other side when the steering oil cylinder 126 is controlled to withdraw.

As shown in FIG. 1, the shear-fork type lifting structure 21 is formed by connecting a plurality of shear-fork units 211, one end of the shear-fork unit 211 at the bottom is hinged to the running chassis 1, the other end of the shear-fork unit 211 is hinged to a sliding block 212, and the sliding block 212 is in sliding fit with the running chassis 1. The lifting device further comprises a lifting detection and control system, the lifting detection and control system comprises a potentiometer 213 installed on the rotation shaft of the shear-fork type lifting structure 21 and a controller, any lifting height corresponds to the unique rotating angle of the rotation shaft, the potentiometer 213 can show a unique resistance value, the unique resistance value corresponding to all heights is recorded in the controller, and the limit on the lifting height of the lifting device is achieved by setting the resistance value.

As shown in FIG. 3, the chassis body 11 further comprises a pit hole assembly, the pit hole assembly comprises a flip plate 11-1, a clamping claw 11-2, a lower connecting rod 11-3, a middle connecting rod 11-4 and a press rod 11-5, the press rod 11-5 is movably installed inside a sleeve, the upper end of the press rod is pressed by the lifting device 2, the lower end of the press rod abuts against a press wheel rotatably connected to one end of the middle connecting rod 11-4, the other end of the middle connecting rod 11-4 is rotatably connected with one end of the lower connecting rod 11-3, the other end of the lower connecting rod 11-3 is movably connected with one end of the clamping claw 11-2, and the clamping claw 11-2 is used for fixing the flip plate 11-1. The middle of the middle connecting rod 11-4 is rotatably connected to the base plate 11-6 through a first shaft 11-7, and the other end of the clamping claw 11-2 is rotatably connected to the base plate 11-6 through a second shaft 11-8. When the lifting device 2 descends, the lifting device 2 presses the upper end of the press rod 11-5, a force is transferred to one end of the middle connecting rod 11-4 through the press wheel and then is transferred to the other end of the middle connecting rod 11-4 through rotation of the middle connecting rod 11-4, the force is transferred to the lower connecting rod 11-3, the lower connecting rod 11-3 transfers a part of the force to the clamping claw 11-2, and the other part of the force acts on an air rod 11-9 to make the air rod 11-9 withdraw and accumulate potential energy in the air rod 11-9. In addition, due to the fact that the clamping claw 11-2 and the flip plate 11-1 are fixed, the flip plate 11-1 can be put away. When the lifting device 2 ascends, the stress exerted on the upper end of the press rod 11-5 is released, the potential energy stored in the air rod 11-9 is converted, the air rod 11-9 is opened and acts on the lower connecting rod 11-3 in a force mode, on the one hand, the flip plate 11-1 is driven to be erected, and on the other hand, the press rod 11-5 is reset through force transfer to adapt to pressing again from the lifting device 2. When the flip plate 11-1 is erected, the complete machine can be prevented from being caught in a pit hole.

What is claimed is:

1. A hydraulic steering shear-fork aerial work platform comprising a running chassis and a lifting device, wherein:

the running chassis comprises:

a chassis body; and a running device comprising a left steering wheel, a right steering wheel, a left wheel carrier, a right wheel carrier, a linkage frame, and a steering oil cylinder, wherein the left steering wheel and the right steering wheel are respectively installed on the left wheel carrier and the right wheel carrier, and wherein the left wheel carrier and the right wheel carrier are rotatably installed on the chassis body through wheel carrier shafts;

wherein the running chassis is characterized in that two ends of the linkage frame are respectively hinged to the left wheel carrier and the right wheel carrier;

wherein the linkage frame further comprises a steering oil cylinder installing portion for a first end of the steering oil cylinder to be installed; and wherein a second end of the steering oil cylinder is connected with at least one of the wheel carrier shafts through an installing plate, so that the left steering wheel and the right steering wheel turn towards a first side when the steering oil cylinder is controlled to extend, and the left steering wheel and the right steering wheel turn towards a second side when the steering oil cylinder is controlled to withdraw;

wherein the lifting device comprises a shear fork lifting structure and a lifting platform, wherein the shear-fork lifting structure is formed by connecting a plurality of shear-fork units, and wherein a first bottom end of each shear-fork unit is hinged to the running chassis, and a second end of each shear-fork unit is hinged to a sliding block that is in sliding fit with the running chassis;

wherein the lifting device further comprises a lifting detection and control system comprising a potentiometer installed on a rotation shaft of the shear-fork lifting structure and a controller, wherein any lifting height corresponds to a unique rotating angle of the rotation shaft, wherein the potentiometer is configured to correspond to a unique resistance value corresponding to all heights recorded in the controller, and wherein a limit on a lifting height of the lifting device is configured to be achieved by setting a resistance value correlated with the limit on the lifting height of the lifting device.

2. The hydraulic steering shear-fork aerial work platform according to claim 1, characterized in that the left steering wheel and the right steering wheel are respectively configured to be driven by a left driving motor fixed to the left wheel carrier and a right driving motor fixed to the right wheel carrier.

3. The hydraulic steering shear-fork aerial work platform according to claim 1, characterized in that the running device further comprises a left rear wheel and a right rear wheel that are respectively configured to be driven by a left driving motor and a right driving motor fixed to the chassis body; wherein the left steering wheel and the right steering wheel are installed respectively through a left wheel connecting disc fixed to the left wheel carrier and a right wheel connecting disc fixed to the right wheel carrier.

4. The hydraulic steering shear-fork aerial work platform according to claim 1, characterized in that the chassis body further comprises a pit hole assembly comprising a flip plate, a clamping claw, a lower connecting rod, a middle connecting rod, and a press rod, wherein the press rod is movably installed inside a sleeve, wherein an upper end of the press rod is pressed by the lifting device, a lower end of the press rod abuts against a press wheel rotatably connected to a first end of the middle connecting rod, wherein a second end of the middle connecting rod is rotatably connected with a first end of the lower connecting rod, wherein a second end of the lower connecting rod is movably connected with a first end of the clamping claw, and the clamping claw is used for fixing the flip plate;

wherein a middle portion of the middle connecting rod is rotatably connected to a base plate through a first shaft, and a second end of the clamping claw is rotatably connected to the base plate through a second shaft;

such that when the lifting device descends, the lifting device presses the upper end of the press rod, a force is transferred to the first end of the middle connecting rod through the press wheel and then is transferred to the second end of the middle connecting rod through rotation of the middle connecting rod, wherein the force is transferred to the lower connecting rod, the lower connecting rod transfers a first part of the force to the clamping claw, and the remaining part of the force acts on an air rod to make the air rod withdraw and accumulate potential energy in the air rod;

wherein the clamping claw and the flip plate are fixed such that the flip plate can be put away;

when the lifting device ascends, the stress exerted on the upper end of the press rod is released, the potential energy stored in the air rod is converted, the air rod is opened and acts on the lower connecting rod in a force mode, in a first configuration the flip plate is driven to be erected, and in a second configuration, the press rod is reset through force transfer to adapt to pressing again from the lifting device;

when the flip plate is erected, a complete machine can be prevented from being caught in a pit hole.

* * * * *